United States Patent [19]

Webster

[11] Patent Number: 5,046,321

[45] Date of Patent: Sep. 10, 1991

[54] METHOD AND APPARATUS FOR GAS CONDITIONING BY LOW-TEMPERATURE VAPORIZATION AND COMPRESSION OF REFRIGERANTS, SPECIFICALLY AS APPLIED TO AIR

[75] Inventor: Sherwood F. Webster, Washington, D.C.

[73] Assignee: Thermotek, Inc.

[21] Appl. No.: 349,779

[22] Filed: May 10, 1989

Related U.S. Application Data

[62] Division of Ser. No. 268,878, Nov. 8, 1988, Pat. No. 4,866,947.

[51] Int. Cl.[5] ..... F25B 1/08

[52] U.S. Cl. ..... 62/116

[58] Field of Search ..... 62/500, 115, 117, 196.4, 62/498, 116

[56] References Cited

U.S. PATENT DOCUMENTS

| | | | |
|---|---|---|---|
| 1,765,674 | 6/1930 | Inman et al. | 62/500 X |
| 2,512,869 | 6/1950 | McBroom | 62/500 X |
| 3,134,241 | 5/1964 | Johnson | 62/500 X |
| 3,557,570 | 1/1971 | Brandt | 62/500 X |
| 4,187,695 | 2/1980 | Schumacher | 62/500 X |
| 4,303,123 | 12/1981 | Skoog | 165/166 |

FOREIGN PATENT DOCUMENTS

| | | | |
|---|---|---|---|
| 773393 | 10/1980 | U.S.S.R. | 62/500 |

*Primary Examiner*—William E. Tapolcai
*Attorney, Agent, or Firm*—J. Gibson Semmes

[57] ABSTRACT

A thermodynamic constant volume vapor compression heat pump system including method and apparatus wherein a closed fluid loop having first, intermediate and second treatment stations, is employed. A liquid refrigerant fluid under low pumping pressure is introduced to a first treatment station following initial expansion, accelerating propulsion, and atomization thereof, precedent to evaporation of the refrigerant fluid through a divisive containment of the accelerated refrigerant fluid. A counterflowing of a warm contained fluid under treatment occurs in heat-exchange conduction relation to the refrigerant fluid, proximal the vaporizing refrigerant of the laminar flow thereof is disturbed at no greater than one atmosphere; thereafter the vaporized refrigerant fluid is compressed at an intermediate station while diverting no greater a measure than 10% thereof to sequentially augment propulsion of oncoming liquid refrigerant through said first station; thence, the remaining bulk of compressed refrigerant fluid is passed under high pressure through a second treatment station wherein the compressed refrigerant vapor is sequentially condensed by reverse-evaporation, the compressed refrigerant fluid being subjected at said second station to external conductive influence of a coolant fluid, said respective coolant fluids being divisively confined in counterflow conduction relation, and the steps aforesaid are repeated seriatim, cyclically.

1 Claim, 2 Drawing Sheets

METHOD AND APPARATUS FOR GAS CONDITIONING BY LOW-TEMPERATURE VAPORIZATION AND COMPRESSION OF REFRIGERANTS, SPECIFICALLY AS APPLIED TO AIR

This is a divisional of co-pending application Ser. No. 07/268,878 filed on Nov. 8, 1988, now U.S. Pat. No. 4,866,947.

BACKGROUND OF THE INVENTION

The invention encompasses method and apparatus for obtaining gas conditioning by low-temperature vaporization and compression of refrigerants. Modern refrigeration and air-conditioning systems are relatively unchanged from the original units developed in the late 1920's and early 1930's. Although some methods had been developed earlier, the modern industry began with the discovery of freon by Thomas Midgely and Charles Kettering in 1928. Freon is a chlorofluorocarbon that is ideally suited to refrigeration in simple systems because of its low boiling point and low heat of vaporization, in addition to its stability, nontoxicity, and nonflammability. These characteristics made freon and its variations the refrigerant of choice in most of the refrigeration units built to date, given the relatively inefficient means provided for vaporizing that refrigerant.

In many of these earlier systems, as little as half of the refrigerant was vaporized, resulting in a serious loss of efficiency. This unfortunate result was due to the limited opportunity afforded the refrigerant to absorb the heat necessary to change its liquid state to a vapor. In these systems, an evaporator coil was filled with liquid refrigerant and the pressure reduced as it passed through the expansion valve. By the time the refrigerant completed its tortuous path through the lengthy evaporator coil, vapor slowly began to form, heat was absorbed, and the gas compressed to pass through the cycle repeatedly. The remaining liquid was diverted by suction tubes to the high pressure side because it would damage the compressor if it passed through with the vapor. Conversion of as much of the refrigerant to vapor as possible is very important, because the change of state can result in thermal transfers up to 50 times as large as mere pressure changes alone. Any refrigerant that does not change "state" represents lost heat absorption potential.

The refrigeration systems of the past 60 years have accordingly been improved in various ways, including providing larger surfaces in heat exchangers, variable rate compressors, etc. but the basic operation of these units, which are dependent of chlorofluorocarbons (hereinafter CFC's) to overcome their inherent inefficiencies, have not. As long as freon continued to be available without restriction, there was little pressure to improve the process of vaporization because freon was "good enough." It allowed a multi-billion dollar industry to be established worldwide and did much to improve health and living standards everywhere. Unfortunately, environmental problems associated with their use have become so severe that the chlorofluorocarbon option will soon be unavailable.

The recent determination that CFC's are causing serious depletion of the critical ozone layer has led to a fundamental rethinking of out tolerance of CFC's as refrigerants. Because CFC's are such stable compounds, they eventually reach the upper atmosphere where they are bombarded by cosmic rays. This causes the molecular bonds to be broken, in turn freeing the chlorine atoms. Chlorine acts as a catalyst in the destruction of ozone ($O_3$) molecules, even though it does not combine chemically with it. The ozone is reduced to normal oxygen ($O_2$) by this catalytic action. One chloride atom can destroy as many as 100,000 ozone atoms before it is returned to the surface in precipitation.

This is recognized as a serious problem because the ozone layer is an efficient reflector of harmful ultraviolet radiation from the sun. Without that layer, which has been thinning rapidly in direct response to the increased use of CFC's, even brief solar exposure to unprotected humans could result at the least in serious sunburn. Longer exposures could be life-threatening: including severe burns, skin cancer, and other negative health consequences.

CFC's are known to be 10,000 times more likely than $CO_2$ to cause the "greenhouse effect", CFC's alone account for approximately 20 percent of that problem. This undesirable effect is created by the retention in the atmosphere of heat energy by the CFC's $CO_2$, and methane which, when combined, allow the incoming sunlight to pass through, but not the heat that is produced when the light is absorbed on the surface of the earth.

The ozone depletion problem has become so severe a threat to global health that it has become the object of the international treaty (the Montreal Protocol.) That treaty, to which the United States is signatory, is expected to reduce CFC production by 50 percent by the end of the 1990's. The EPA recently announced that the problem was so severe that by 1998 it would completely ban CFC's in the United States. As indicated above, several major CFC producers have already announced their intention to scale back CFC production and to eventually cease it completely. CFC's are obviously on their way out.

The refrigeration and air conditioning industries, however, clearly face major dilemma because of this phase out, as does the world in general, which is highly dependent on a CFC source of cooling for food preservation and human comfort. These industries, it is anticipated, will survive, along with living standards of much of the world, only if new refrigerants can replace known CFC's. Several possibilities exist, but the most promising is 134A, a nonchlorinated fluorocarbon. It meets the requirements of being environmentally benign, nontoxic, stable, nonflammable, and affordable. 134A is, nevertheless, more difficult to convert from a liquid to a gas, because of its greater heat of vaporization and its high pressure range. In existing systems, 134A has not performed well and has not produced the temperature reductions that users need. Other potential refrigerants are even more difficult than 134A to vaporize and require more work to condense. Accordingly, the present invention addresses the adaptation of such refrigerant compounds as 134A and a wide variety of new refrigerants to function efficiently in such fields as air conditioning and heating.

It is apparent that the present new technological approach to refrigeration is needed. The principal reason that such technology has changed so little in the last 60 years is that there was no real social or economic pressure for it to change. As long as freon was acceptable as a refrigerant, inefficient and primitive systems considered to function adequately. Now that such easily vaporized materials will no longer be available, a fundamental system change in hardware becomes necessary to accommodate the new family of refrigerants which this system will make practical.

The heat pump apparatus and method defined hereinafter present that technological breakthrough. It is a substantial improvement in all, not just one or two, phases of the refrigeration cycle. It will allow the use of 134A or virtually any other potential refrigerant, all with higher optimum efficiency than exists in any existing system. The refrigerant 134A is defined herein as:

"Heat pump" herein comprises an engine or reversible engine, capable of functioning either as a producer of refrigeration or heat under the Carnot principle.

SUMMARY OF INVENTION

In the present heat pump system, much colder temperatures can be attained with less energy input then under past practices. This will occur because substantially all of the contained liquid refrigerant will be vaporized herein. During the desired change of liquid state, heat is absorbed by the refrigerant. In conventional systems, as little as half of the CFC or freon would vaporize, despite its low boiling point, the opportunity for energy transfer thus being so limited. In this system, instead of moving the refrigerant vapor through a conventional expansion valve (essentially a gate which separates the high pressure side of the circuit from the low pressure side,) the refrigerant is sprayed into the accelerator as droplets by a new spraying expansion valve which is similar to a fuel injector on an automobile engine. The pressurized gas from the compressor is purposely diverted to the back of the accelerator and is injected radially so that it can accelerate rapidly and can acts as a propellant for the oncoming droplets of liquid refrigerant. These refrigerant droplets are accelerated forward by the onrush of a carefully controlled radially injected vapor. This radial injection phase of the system insures even, accelerated distribution of the refrigerant and highly turbulent flow which is essential to full vaporization of the refrigerant, per se. For purposes of clarity, this apparatus has been adapted to a counterclockwise, closed conduit, continuously operable cycle.

A primary reason underlying the inefficiency of existing units is that so little attention has been given to preparing the refrigerant for vaporization. This is also the reason that new refrigerants having high heat of vaporization respectively will not work effectively in conventional units. New units employing the concepts described hereinafter will be necessary to allow extraordinary rapid heat transfer such as will be required to achieve the objectives of invention.

One very important feature of the present heat pump system is the preselected screen matrix consisting preferably of two stainless steel screens: the first by way of example only, a #30-100 coarse immediately followed by a #120 fine. Despite its simplicity, this matrix performs some extraordinary functions. In practice, preselected liquid refrigerant composition is injected through expansion valves which transform the oncoming liquid into relatively small droplets. These are immediately propelled by radially injected gas from the compressor toward the screen matrix at several hundred miles per hour. These already small droplets are hurled at the matrix with great force. The wide openings in the inner screen, #30-300 coarse mesh, act as funnels to separate the flow into multiple, tightly focused refrigerant streams that are sequentially directed into even smaller orifices, formed by the outer screen, #100-300 fine mesh. The effect comprises the development of a matrix of tens of thousands of small openings through which the propellant can force the refrigerant.

Forcing of the refrigerant through this matrix produces extremely small droplets within the range of 3-5 microns in diameter. Because the orifices are disposed so close together in the selected screen matrix, their cones of dispersion intersect. This results in additional droplet deformation reducing the diameter per droplet to approximately one micron. This reduction in droplet size is extremely important and cannot be overemphasized. For example, surface area is known to be critical in the rapid vaporization of a liquid because the necessary heat may be absorbed from the surrounding environment much more quickly over an exposed large area than over a small one. This eliminates the need for boiling the refrigerant. The adiabatic low pressure on the downstream side of the screen matrix also facilitates vaporization by reducing the heat requirement. Having summarized the invention, attention is now directed to the drawings and ensuing detailed description.

BRIEF DESCRIPTION OF THE PREFERRED EMBODIMENTS

Figure 1:
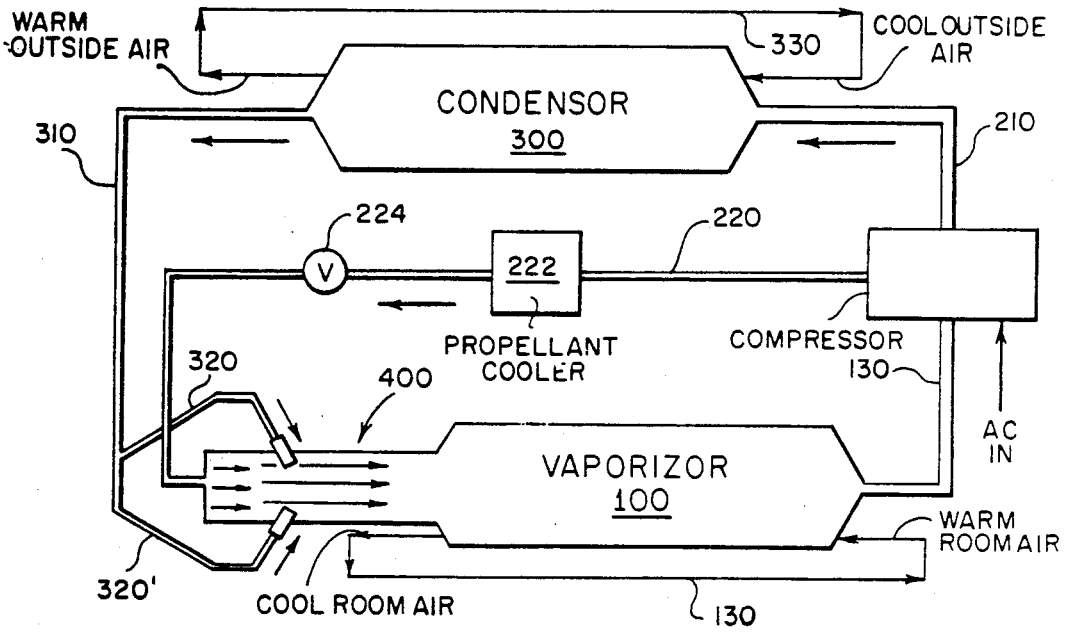
FIG. 1 depicts the invention as a schematic of apparatus employed in a preferred form for operation under the invention.
Figure 3:
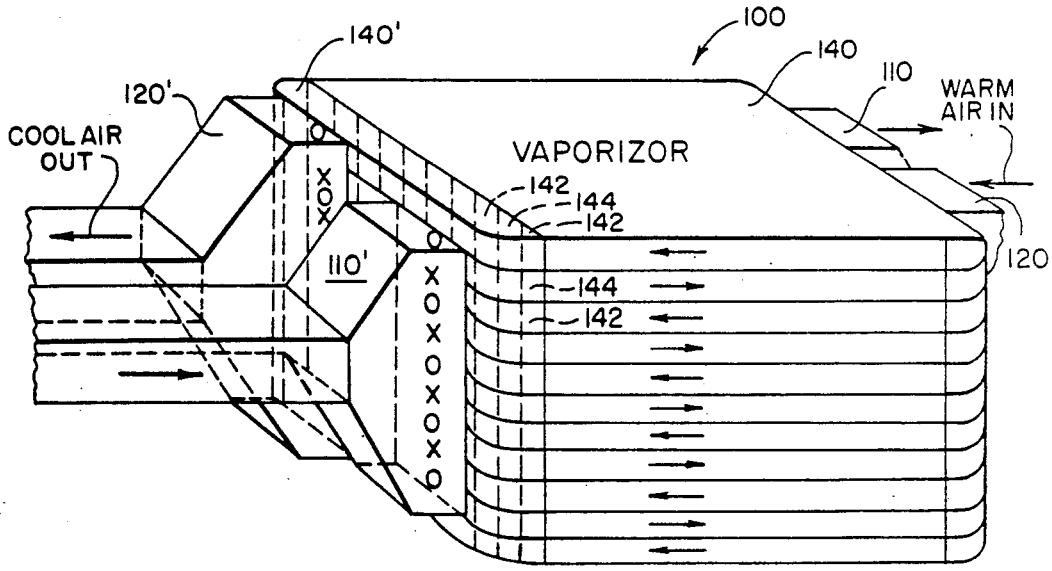
FIG. 3 is a perspective schematic illustrating the vaporizer, per se wherein are depicted the means for ducting atomized liquid refrigerant into and its vapor out of the vaporizer, as well as room air into and cool air out of the vaporizer.

A thermodynamic, constant volume low-temperature vaporization and compression refrigerant system including method therefore is defined herein, the same being especially reversibly suited to air conditioning. It is characterized by a closed loop fluid unit wherein the ultimate coefficient of performance, comparative to that of a conventional vapor compression system is measurably enhanced. See FIG. 1. In counterclockwise assembly, the vapor compression apparatus includes in the low pressure zone and in sealed conduit connection, a channeled-matrix vaporizing heat exchanger 100, the downstream end of which connects through plenum 110 with low pressure refrigerant vapor conduit 130, the latter providing input to compressor 200. The vaporizer 100 is a heat exchanger, the output and input manifolds 140—140' of which feed a matrix of alternate levels of bidirectional heat exchange channels 142-144. See FIG. 3. The plenums 110—110' and 120—120' are tiered and compartmented according to the coactive heat exchange relationship of the ducts 142-144. Thus each manifold has alternate open (O) and closed (X) tiers to admit or block onrushing air and/or refrigerant through manifolds 140—140'. Channels 142 have interconnection for incoming warm air to be conditioned from conduit 130', whereas channels 144 receive in counterflow, the atomized liquid refrigerant from conduit 230. The heat exchanger 100, thus defines within a matrix of channeled ducts 142-144 having square rather than round transverse cross section. See FIG. 3. There are preferably ten horizontal tiers and eleven vertical tiers 142-144, each of which is divided into ten separate channels. The incoming atomized refrigerant liquid is to be propelled from accelerator manifold 400 to forcibly enter through the plenum 140 into the alternating ducts. Room air to be conditioned counterflows into the unit 100 from a similar plenum 140' on the opposite end of the heat exchanger 100. Each duct 142-144 of the exchanger 100 is preferably less than 1.5 feet long and defines several small, angled baffles not shown, along the interior length thereof. This promotes turbulence within respective heat exchanger ducts, in order to maximize interior contact in vaporizing the refrigerant, which while passing through ducts 144 is searching for heat, with the adjoining ducts 142 which are conducting incoming warm room air in the opposite direction. By the end of the passage of the refrigerant through these ducts 144, it is fully vaporized and heat having been removed, room air is consequently thoroughly chilled. Each tier of channels 144 carrying refrigerant is substantially completely surrounded by tiers (142) carrying room air tiers 142, and each tier 142 carrying room air is likewise substantially surrounded by refrigerant tiers 144, except of course for those few which are disposed on the outer surface of the heat exchanger. This arrangement of FIG. 2 accordingly provides an extraordinarily high surface area over which thermal transfer will take place.

Again, at the low pressure first stage, the heat absorbed vapor is educted under low pressure via duct 120 to compressor 200, the latter passing a major portion of the vapor under high pressure via conduit 210 to the reverse evaporator/condenser 300 which is a substantial duplicate of the vaporizer 100, although lacking in any refrigerant preconditioning unit 400. Reverse-evaporator-condenser 300 being a substantial counterpart of the heat-exchanger 100, has the essential components thereof disposed in reverse, onstream of the device. Its function is to reject the heat of vaporization by subjecting it to high pressure and by providing a large condensation surface. Additionally, this unit 300 is designed to dissipate heat by means of the counterflow heat-exchange defined hereinbefore.

A minor portion of the vapor refrigerant, not to exceed 10%, is diverted from the compressor through conduit 222 to ultimately enhance propulsion of high pressure liquid emanating from the compressor.

This portion of the propellant while under pressure is cooled by any suitable means 220, its output volume being controlled by valve 224, precedent to being dispersed through the radial propellant injector 440 of the manifold 400. The disposition of injectors 440 upstream of refrigerant expansion valves 330—330' are critical. These expansion valves are set within conditioner manifold 400 at a downstream angle of approximately 30°, relative to each other to insure mutual impingement of opposed jet streams of liquid derived from the condenser 300. To summarize, within that high pressure liquid conversion zone represented by the lowermost segment of lower FIG. 1, the quadruple element liquid accelerator manifold 400 contains in axial displacement: radial propellant injectors 440, operatively connected to the output of auxiliary cool vapor diversion conduit 222, followed onstream by the disposition of refrigerant injector, expansion valves 330—330', plural baffles 450—450'—450'' and finally the multiple screen matrix 460 which is disposed across the entire cross section of the accelerator outlet to conditioner manifold 100 See FIGS. 2 and 3.

OPERATION

The major content of vaporized cooling refrigerant charge such as gas 134A is pumped by the compressor 200 to the reverse evaporator or condenser 300 whereupon it is thence conducted via conduits 310-320—320' under high pressure into the expansion valve nozzles 330—330', these nozzles being suitably housed in a plenum portion of the suction line conduit 320. Upon activation of the closed loop unit, compressor 200 will pump through conduit 222 hot propellant vapor at 200-300 mph. This comprises up to 10% of the compressor output volume at a point which is well upstream of the liquid expansion valve nozzles 330—330'.

Figure 2:
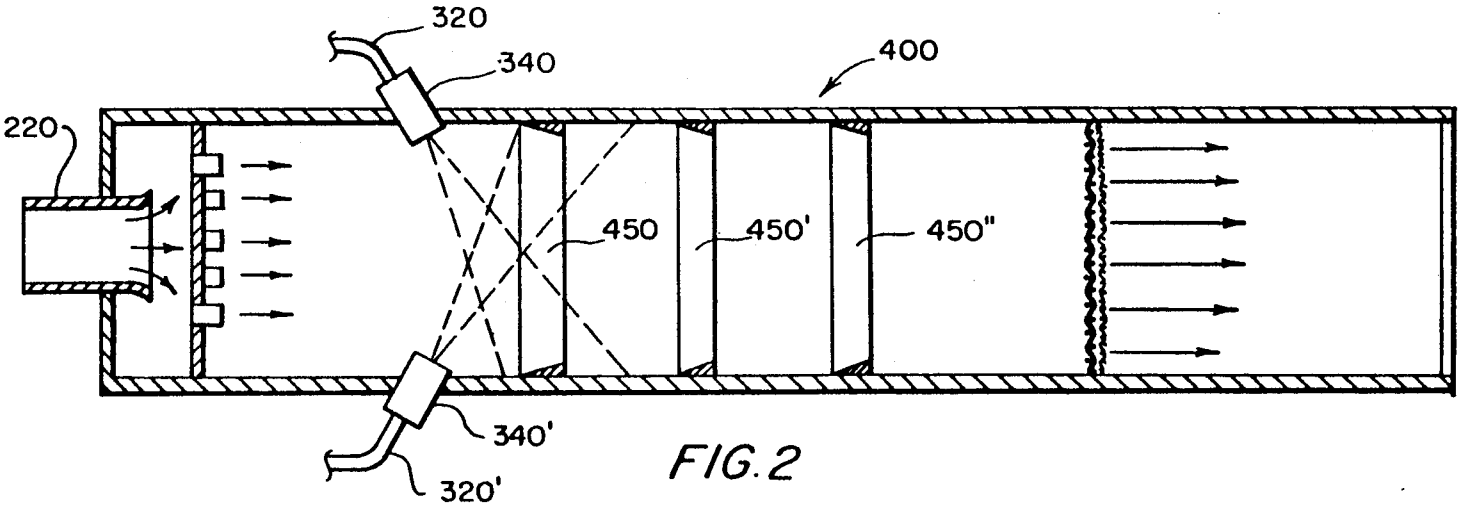
FIG. 2 is a vertical sectional view of the propellant accelerator manifold taken along lines 2—2 of FIG. 1.
Figure 2C:
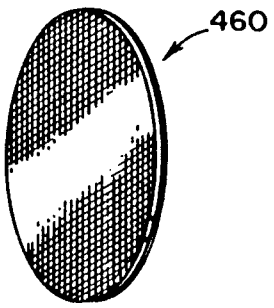
FIG. 2C is a view in perspective of the FIG. 2 activator diffusion screen matrix which is disposed immediately on-line with the attached vaporizer.
Figure 2B:
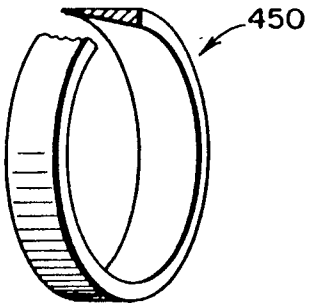
FIG. 2B is a view in perspective of one of the plural baffles illustrated in FIG. 2.
Figure 2A:
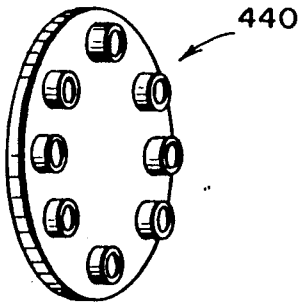
FIG. 2A is a view in perspective of the radial propellant injector assembly having injectors disposed in circular array.

Accelerator and conditioner manifold 400 receives cooled propellant vapor from the compressor forcing it through injector 440 in a circular array and the vapor charge is sequentially atomized to approximately 50 microns not only by radial injection of vapor through the injector 440 but also by the combined mutual impingement of droplets from high pressure expansion of valves 330—330' and propellant is thus accelerated onstream through the plural turbulence baffles 450—450'' thence through the screen matrix 460. An upstream coarse stream screen of #30-#100 (preferably #45 mesh) and a downstream fine screen of #100-300 (preferably #120 mesh) is suitable, provided these screens are not separated by any intervening space. They are mounted in direct contiguous contact with each other, as shown in FIG. 2 and 2C element 460. FIGS. 2A and 2B illustrate the configuration of the elements 440-450 most clearly.

Whereas in prior art air conditioning, one would move liquid refrigerant through an expansion valve or gate separating a high pressure from low pressure locus, on the contrary, this condensed liquid refrigerant is, as indicated, forced under high pressure to radial refrigerant injectors 440 which serve as spray-type expansion valves, similar to automotive fuel injectors. To the extent that liquid refrigerant reaches an opposite side of the multi-phase accelerator manifold from the injectors, secondary atomization resulting from impingement of the two streams outward from valves 330—330', will produce even smaller droplets onstream. Critical to the change-of-state process in the heat pump herein is this valvular injection of high-pressure refrigerant vapor as a propellant. A small amount of vapor, less than ten percent of the total flow, diverted from the output of the compressor, preferably cooled in a heat exchanger is thence conducted under pressure into the accelerator manifold whereupon it has previously been divided by radial propellant injectors into at least eight smaller flows of even higher pressure and velocity. Vapor under high pressure is thus injected coaxially through radially dispersed openings at very high speeds, viz: 300 MPH. This creates even distribution that is essential to full vaporization. This onrush of new propellant vapor is intercepted by the droplets of injected refrigerant liquid from the condenser and hurtles these droplets toward the screen matrix 460 much like a stone in a slingshot. On its way to the screen matrix the vapor-droplet flow encounters three small on-line turbulence inducers 450—450'—450'', rings of flat metal, angled 30° from the horizontal axis of the manifold, to break up laminar flow of vapor and ultimately to direct a substantial measure of that flow toward the center of the screen matrix 460. Accordingly, these already small droplets are hurled at the matrix with great force. The wide openings in the upstream screen coarse mesh (#30–#100) act as funnels to separate the flow into multiple, tightly focused refrigerant streams that are then directed into even smaller orifices (#100–#300) formed by the downstream fine mesh screen. The effect is to create via the screens a matrix of tens of thousands of small openings through which the vapor propellant will force the liquid refrigerant. Forcing of the refrigerant droplets through the matrix 140 produces extremely small droplets of approximately 3–5 microns in diameter. Because the orifices are so close together in the screen matrix, their cones of dispersion must intersect. This results in additional droplet deformation that reduces the diameter per droplet to approximately one micron. A given volume of small droplets will have many times the surface area as the same volume of large droplets. As is known, surface area is critical in the rapid vaporization of a liquid, because the necessary heat can be absorbed from the surrounding environment much more quickly over a large area than over a small one. The induced low pressure on the downstream side of the screen matrix also facilitates vaporization by reducing the heat requirement. Heat exchange is thereafter facilitated by the low pressure means indicated in FIGS. 1 and 3.

Once that low pressure heat exchange is complete, the refrigerant vapor is thereafter compressed and sent under high pressure through the condenser. In this unit, heat is removed and the refrigerant liquefied so that it may be recycled to provide more refrigeration within the high pressure area. Because the new refrigerants absorb more heat, they consequently release more heat when liquefied. Combined with the high efficiency of the condenser, this greater energy density does provide very high yields of usable heat, with less energy consumed in its production.

The phase of high pressure portion of the overall system presents a very efficient heat pump in cold weather, with operating costs well below that of natural gas furnaces. This also provides without modification a low-cost source of heat and will allow the electric utilities to even their loads from season to season. Wide use of this type of heat pump for air conditioning in summer eliminates the need for expensive peak shaving and would increase demand in the winter for heating, thereby spreading the baseload more evenly for the electric utilities.

I claim:

1. A thermodynamic constant volume vapor compression refrigeration method the steps of which are performed within a closed fluid loop having first, intermediate and second treatment stations, comprising:

A) initially injecting a vaporizable liquid refrigerant fluid under high pumping pressure through a first treatment station before evaporation thereof wherein an accelerating propulsion applied to the injected refrigerant fluid is conducted by valve injection under high pressure of a diverted minor portion of refrigerant which has been vaporized and wherein an atomization of the liquid refrigerant fluid is obtained by propelling droplets thereof through a matrix of contiguously disposed screens, at least an upstream screen comprising a coarse mesh of between #30 and #100 mesh and a downstream of #100–#300 mesh and counter-flowing a comparatively warmer fluid under treatment, which said latter fluid is propelled in conduction heat-exchange relation to the refrigerant fluid, while disturbing the laminar flow of the former fluid at no greater than one atmosphere;

B) thereafter compressing the now vaporized refrigerant at an intermediate station, while diverting no greater a measure than 10% thereof to augment propulsion of oncoming liquid refrigerant from a second treatment station through the first treatment station;

C) thence passing a major measure of said compressed refrigerant through a second treatment station under high pumping pressure, wherein said compressed refrigerant is sequentially condensed by reverse evaporation, said compressed refrigerant being subjected at said second station to external conductive influence of a coolant fluid, said respective coolant and refrigerant being divisively confined in counterflow heat-exchange conduction relation at said second station;

E) repeating the steps aforesaid cyclically.

* * * * *